US009112294B2

(12) United States Patent
Pade

(10) Patent No.: US 9,112,294 B2
(45) Date of Patent: Aug. 18, 2015

(54) SECONDARY LOCKING MECHANISM FOR A PLUG

(71) Applicant: Wolfgang Pade, Illingen (DE)

(72) Inventor: Wolfgang Pade, Illingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/303,555

(22) Filed: Jun. 12, 2014

(65) Prior Publication Data

US 2014/0378006 A1 Dec. 25, 2014

(30) Foreign Application Priority Data

Jun. 19, 2013 (DE) ..... 10 2013 211 455

(51) Int. Cl.
*H01R 13/629* (2006.01)
*H01R 13/436* (2006.01)
*H01R 13/52* (2006.01)

(52) U.S. Cl.
CPC ..... *H01R 13/4361* (2013.01); *H01R 13/436* (2013.01); *H01R 13/5208* (2013.01)

(58) Field of Classification Search
CPC ..... H01R 13/436; H01R 13/4361
See application file for complete search history.

(56) References Cited

U.S. PATENT DOCUMENTS

| | | | | |
|---|---|---|---|---|
| 5,201,674 | A * | 4/1993 | Okura | 439/595 |
| 5,586,917 | A * | 12/1996 | Yagi et al. | 439/752 |
| 6,045,412 | A * | 4/2000 | Guanco et al. | 439/752 |
| 6,488,541 | B1 * | 12/2002 | Takeuchi | 439/660 |
| 2004/0132351 | A1 * | 7/2004 | Miyakawa et al. | 439/752 |
| 2006/0148331 | A1 * | 7/2006 | Rimke | 439/752 |
| 2014/0378006 | A1 * | 12/2014 | Pade | 439/752 |

* cited by examiner

*Primary Examiner* — James Harvey
(74) *Attorney, Agent, or Firm* — Kenyon & Kenyon LLP

(57) ABSTRACT

A plug for establishing an electrical connection to a plug module includes: a plug body having a contact carrier upper part which includes multiple first channels to accommodate electrical lines, and a plug base accommodating a collar of the plug module; a contact carrier lower part which includes multiple second channels to accommodate the electrical lines; and a locking element insertable into the plug from the outside and configured to fix the electrical lines in the channels. The first channels terminate in the second channels to form continuous channels accommodating the electrical lines. The contact carrier lower part is enclosed by the collar of the plug module and accommodates multiple electrical contacts of the plug module in order to establish electrical connections between the multiple electrical lines in the plug and the multiple electrical contacts of the plug module.

11 Claims, 5 Drawing Sheets

SECONDARY LOCKING MECHANISM FOR A PLUG

BACKGROUND OF THE INVENTION

1. Field of the Invention

The present invention relates to a plug for creating an electrical connection to a plug module, e.g., a wiring harness for a control unit in a motor vehicle.

2. Description of the Related Art

Numerous electrical and electronic control units, which must be electrically connected to each other and to other components in the vehicle, such as sensors and actuators, for example, are installed in the engine compartment and in the body shell of a vehicle.

A control unit may be equipped with a plug module for this purpose, at whose male multipoint connector a few hundred electrical contacts may be situated, such as for a power supply or for the transmission of signals. A corresponding plug, which is connected to a wiring harness, can be plugged into the plug module in order to establish an electrical connection.

A durable and stable electrical connection between the wiring harness and the plug must be ensured in order to avoid a failure of a control unit as a result of an interruption in the power supply or in the signal transmission. A secondary locking mechanism is frequently used for this purpose, so that electrical lines are fixed in place inside the plug at a location in the interior of the plug where it is ensured that the electrical lines inside the plug are connected to electrical contacts of the plug module once the plug has been plugged into the plug module.

BRIEF SUMMARY OF THE INVENTION

Specific embodiments of the present invention advantageously make it possible to provide a plug for a wiring harness of a vehicle which is able to ensure a reliable electrical connection, especially in cases where the plug has a miniaturized design.

According to one specific embodiment of the present invention, the plug has a plug body, which in turn is provided with a contact carrier upper part having a plurality of channels for accommodating electrical lines, and a plug base, the plug base being developed to accommodate a collar of a plug module when the plug is plugged into the plug module in order to create an electrical connection. In addition, the plug has a contact carrier lower part, which is provided with a plurality of channels to accommodate the electrical lines, the channels of the contact carrier upper part terminating at the channels of the contact carrier lower part and forming continuous channels in the process in order to accommodate the electrical lines. The contact carrier lower part is designed to be enclosed by the collar of the plug module and to accommodate a plurality of electrical contacts of the plug module so as to produce electrical connections between the plurality of electrical lines inside the plug and the plurality of electrical contacts of the plug module. Furthermore, the plug has at least one locking element, which is able to be inserted into the plug from an outer side and is designed to fixate the plurality of electrical lines within the channels. To do so, the locking element extends partially in the upper part of the contact support and partially in the lower part of the contact support.

Overall, the plug may be developed to provide a long-lasting and stable electrical connection between electrical lines of a wiring harness in a vehicle and a control unit, among other things. With the aid of the locking element, the lines, especially also of small-dimensioned plugs, are able to be fixed in place inside the channels in a reliable manner.

By inserting the locking element into the plug, it can furthermore be ensured that the electrical lines are correctly positioned within the plug, so that electrical connections between the electrical contacts of the plug module and the electrical lines inside the plug are able to be produced once the plug has been plugged into the plug module. If the electrical lines inside the plug are positioned incorrectly, the locking element cannot be inserted into the plug, or can be inserted only by using excessive force. As a result, the locking element may be used to check the position of the electrical lines inside the plug.

According to one specific embodiment of the present invention, the locking element is provided with a plurality of prongs, in the way of a comb, for fixating the plurality of electrical lines; these prongs are able to be inserted into at least a sub-region of a cross-section of the channels for accommodating electrical lines, so that the electrical lines are pressed against the lower part of the contact carrier and the upper part of the contact carrier and fixed in place in the process.

Ideas in connection with specific embodiments of the present invention may be considered to be based on the discoveries described in the following text, among others. The number of sensors and actuators installed in vehicles and corresponding control units which process the information from the sensors and are able to control the actuators, is increasing steadily. However, the space available in a vehicle for sensors, actuators and control units may be heavily restricted, so that these components of the vehicle are increasingly produced in miniaturized form. This also applies to the associated plugs and plug modules, which may be used to produce electrical connections between the components. For example, it has become apparent that the prongs of the locking element of wiring harness plugs, especially those produced in miniaturized form, may easily break off when inserted into the plug, if the locking element, as is currently the case, is guided in the lower part of the contact carrier exclusively and therefore has a relatively small cross-section.

By guiding the locking element in the upper and the lower part of the contact carrier according to the present invention, the cross-section of the prongs of the locking element is able to be enlarged in an advantageous manner, so that the locking element and, in particular, the prongs of the locking element, are able to be given a more robust form. In addition, the guidance of the locking element is advantageously improved by the larger cross-section of the prongs, so that a stable, long-lasting and thus reliable electrical connection can be ensured.

According to one specific embodiment of the present invention, the locking element fixates the plurality of electrical lines in the plug predominantly by stiction.

Due to the fact that the locking element is guided both in the upper part and in the lower part of the contact carrier, and that the cross-section of the prongs is enlarged as a result, the area that is used to fixate the electrical lines inside the plug by means of stiction and to retain the locking element itself inside the plug is able to be enlarged. As a consequence, the electrical lines in the plug are practically no longer able to slide inside the plug, for instance as a result of vibrations, and the locking element is able to be fixed in place in the plug in a reliable manner. This can advantageously increase the stability and the service life of the electrical connection.

According to one specific embodiment of the present invention, both the upper part and the lower part of the contact carrier have mutually aligned recesses at a boundary surface between the upper and lower part of the contact carrier abutting each channel, into which recesses the locking element is insertable.

By inserting the prongs into the aligned recesses, the electrical lines are able to be pressed against the walls of the channels both in the upper part and the lower part of the contact carrier and thereby be fixed in place.

According to one specific embodiment of the present invention, the prongs of the locking element are designed to engage with the recesses in form-fitting manner.

Since the prongs of the locking element are designed to engage with the recesses in form-fitting manner, it is possible, for one, to use an entire surface of the prongs to fixate the electrical lines and the locking element, and for another, to ensure that the electrical lines are positioned or placed inside the plug in a precise manner; this is due to the fact that in the event of small deviations from the correct position of the locking element, the locking element is no longer able to be inserted into the plug or can be inserted only by using excessive force.

According to one specific embodiment of the present invention, the plug and the locking element are developed in such a way that the locking element is able to be inserted into the plug transversely to a longitudinal extension direction of the channels.

This may have the result that one prong of the locking element is able to fixate multiple electrical lines in multiple channels simultaneously, because if the prongs were inserted along the longitudinal extension of the channels, then one tooth per channel would have to be provided on the locking element. In comparison with a design in which the prongs are inserted along the longitudinal extension of the channels, the design of the present invention furthermore allows the cross-section of the prongs to be of larger size, since a diameter of the channels may be relatively small, especially in cases where the plug has a miniaturized design.

According to one specific development of the present invention, at least two locking elements can be inserted into the plug on sides of the plug that lie opposite from each other.

By inserting two locking elements on two opposite sides of the plug, the prongs of the particular locking elements may be shorter. This allows for a more stable and robust design of the locking elements, and the prongs break off less easily in comparison with a design in which only a single locking element with considerably longer prongs is provided, inasmuch as the lever forces can be smaller in the design according to the present invention. However, the length of the prongs of the two locking elements need not be identical; instead, the lengths chosen for the prongs of both locking elements may also differ. The prongs of a single locking element may differ in length as well. Nevertheless, especially when the plug features a miniaturized design, a plug development providing only a single locking element is of course conceivable as well.

According to one specific development of the present invention, the two locking elements in the previously described embodiment differ with regard to the number of prongs that are able to be inserted into the plug.

As a rule, electrical lines serving different purposes are accommodated in a plug, such as for a power line and for a signal transmission. These may differ both in number and diameter. Due to the different diameters of the lines, the channels for the feed-through of the lines may have different diameters as well. For example, to separate power lines from signal lines as much as possible within the plug, only channels for power lines may be provided in one sub-region of the plug, and only channels for signal lines may be provided in another sub-region, these lines possibly differing in diameter and the number of rows in which they are juxtaposed. This may make it necessary to slide locking elements with a different number of prongs, which may correspond to the number of rows of channels in the particular sub-region of the plug, into the plug in order to be able to correctly position and fixate all electrical lines.

In one specific embodiment of the present invention, the locking element is implemented in one piece.

The one-piece design of the locking element makes it possible to further increase the stability of the locking element, and a production process for the plug is made easier since fewer individual components may be required. In addition, the cost of the production process is able to be reduced in this manner.

According to one specific embodiment of the present invention, the locking element is made of plastic.

Because of its material characteristics, i.e., a material that is able to withstand stresses and simultaneously provide a certain flexibility, plastic may advantageously satisfy the requirements imposed on the locking element. Furthermore, plastic can be brought into the desired shape at a relatively low production expense, e.g., by injection-molding, so that the production process is kept inexpensive. However, it is of course also possible to use other materials for locking elements.

A further aspect of the present invention relates to a plug system having a plug according to the present invention and a plug module for accommodating the plug. The plug system, for example, may be used to establish an electrical connection between a wiring harness and a control unit in a motor vehicle. The plug module may be attached to the control unit, and the plug may be connected to the wiring harness of the vehicle.

It is pointed out that possible features and advantages of specific embodiments of the present invention are described here with reference to different developments of a plug or a plug system. An expert will know that the described features are able to be combined or exchanged in a suitable manner in order to obtain further specific embodiments and possibly, synergy effects.

DETAILED DESCRIPTION OF THE INVENTION

Figure 1:
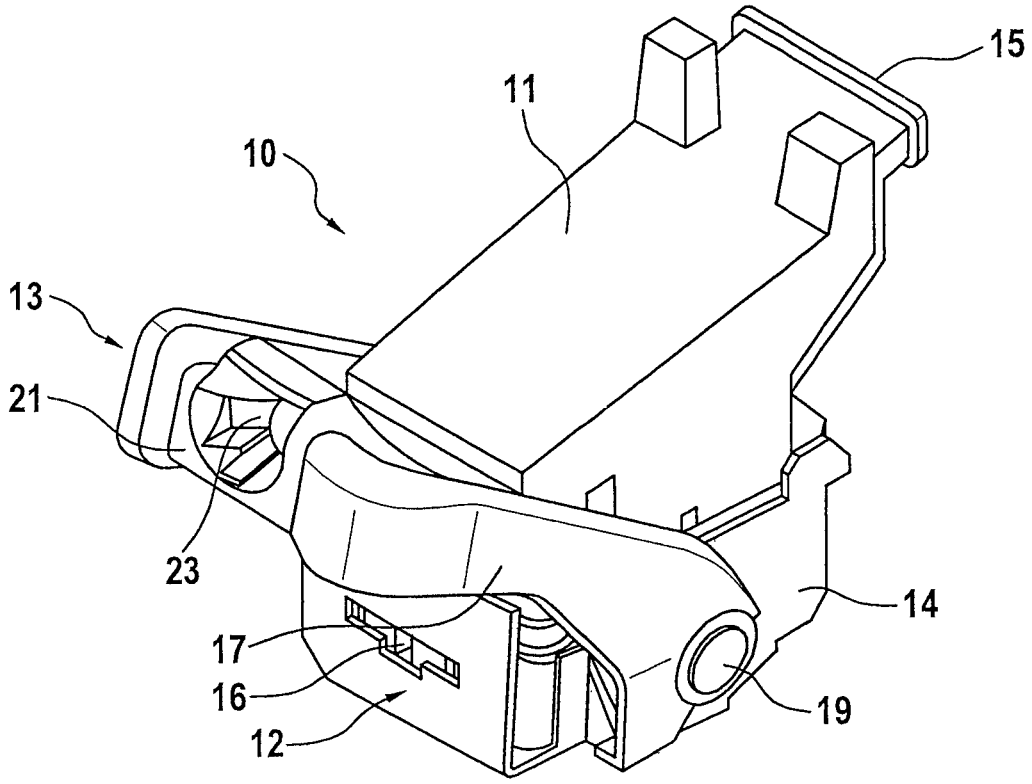
FIG. 1 shows a perspective view of a plug according to one specific embodiment of the present invention.

The figures are merely depicted schematically and not true to scale. Identical or similar components have been provided with the same reference numerals.

FIG. 1 shows a plug 10 having a plug cover 11, a plug lever 13 and a plug body 12. Plug body 12 has a plug base 14, which is able to be plugged into the plug module in order to establish an electrical connection to the plug module (not shown). Plug cover 11 has a receiving opening 15, via which electrical lines of a wire harness are able to be routed into plug body 12.

Furthermore, plug base 14 has a recess 16, via which a locking element 18*a* (see FIG. 2) is able to be inserted into plug 10 from the outside.

Plug lever 13 surrounds plug body 12 in a U-shape by way of two arms 17, at the end of which a shaft 19 is situated in each case. The two shafts 19 are accommodated at two opposite sides of plug base 14. Arms 17 are connected to a crosspiece 21, in which a plug lock 23 is situated.

Plug lever 13 is designed to be moved from a start position to an end position and to pull plug 10 toward the plug module in the process. FIG. 1 shows plug lever 13 in the end position, plug lock 23 being locked together with the plug module in order to secure the electrical connection.

Figure 2:
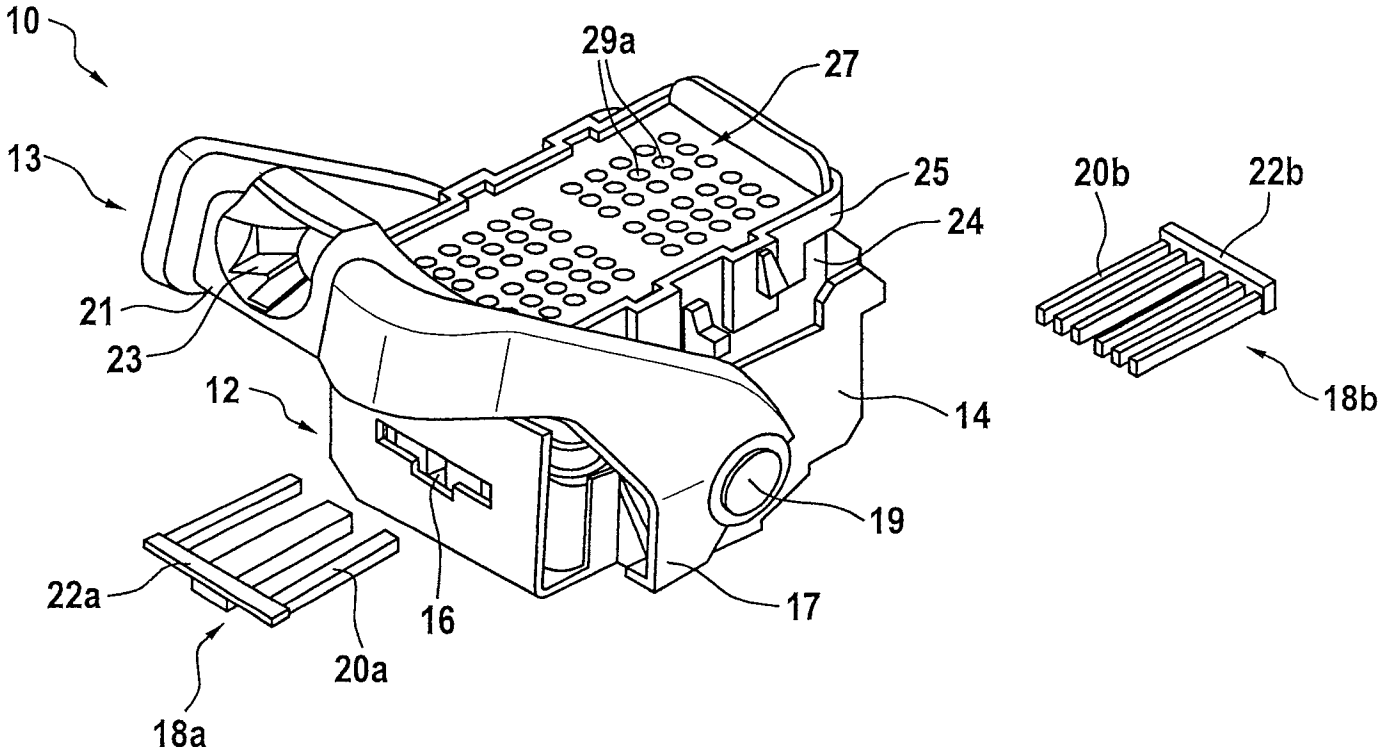
FIG. 2 shows a perspective view of a portion of the plug from FIG. 1.

FIG. 2 shows plug 10 from FIG. 1 without plug cover 11. Plug body 12 has a contact carrier upper part 24, which in turn has a receiving region 25, into which a pressure plate 27 has been inserted. Pressure plate 27 has channels 29*a* for the feed-through of electrical lines into plug body 12.

Furthermore, FIG. 2 shows two locking elements 18*a*, 18*b*, which are insertable into plug 10 across plug base 10 by way of recesses 16 (only one is shown) at two opposite sides of plug 10, and which are designed to fixate the electrical lines inside plug 10.

Locking elements 18*a*, 18*b* have a plurality of prongs 20*a*, 20*b* in each case, which are connected to a crosspiece 22*a*, 22*b* and project from crosspiece 22*a*, 22*b* in the form of a comb. The two locking elements 18*a*, 18*b* may differ in the number and the length of the prongs.

Figure 3:
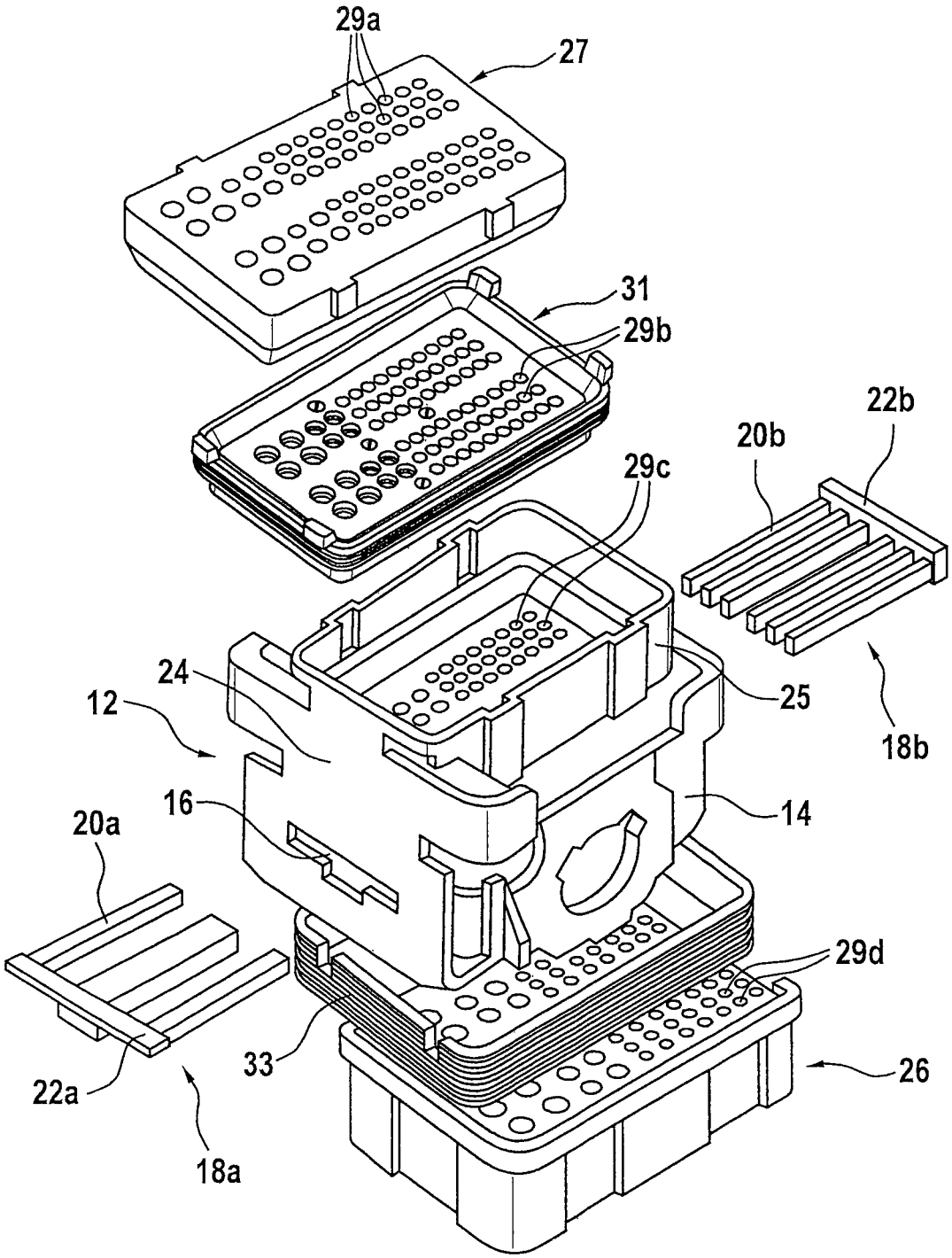
FIG. 3 shows an exploded view of a portion of the plug from FIG. 2.

FIG. 3 shows plug 10 without plug cover 11 and without plug lever 13, in an exploded view. A mat seal 31 is able to be inserted into receiving region 25 of contact carrier upper part 24 of plug body 12, between contact carrier upper part 24 and pressure plate 27.

Mat seal 31 has channels 29*b* for the sealed feed-through of electrical lines. Furthermore, a contact carrier lower part 26 is insertable into plug basis 14, which has channels 29*d* to accommodate electrical lines. When pressure plate 27 and mat seal 31 are inserted in receiving region 25 of contact carrier upper part 24, then channels 29*a* of pressure plate 27 terminate in channels 29*b* of mat seal 31, and channels 29*b* of mat seal 31 in turn end in channels 29*c* of contact carrier upper part 24, which in turn end in channels 29*d* of contact carrier lower part 26, so that continuous channels 29*a*, 29*b*, 29*c*, 29*d* are formed.

Via receiving opening 15 of plug cover 11, the electrical lines of a wiring harness are thus able to be routed through continuous channels 29*a*, 29*b*, 29*c*, 29*d* into plug body 12, the extension of channels 29*a*, 29*b*, 29*c*, 29*d* defining an axial direction of plug 10. If plug 10 is plugged into a plug module, then electrical contacts (not shown) of the plug module are accommodated by contact carrier lower part 26 in order to establish an electrical connection between the electrical contacts of the plug module and the electrical lines in channels 29*a*, 29*b*, 29*c*, 29*d* of plug body 12.

Contact carrier upper part 24, pressure plate 27, mat seal 31 and contact carrier lower part 26 may each have channels featuring different diameters, which can be used for the feed-through or accommodation of electrical lines having differing diameters, such as lines for a power supply and/or lines for a transmission of signals, for instance.

In addition, a sealing element 33 is insertable in plug base 14, between contact carrier upper part 24 and contact carrier lower part 26, which surrounds contact carrier upper part 24 in the interior of plug body 12 and which is designed to be accommodated between a collar (not shown) of the plug module and plug base 14, so that plug 10 plugged into the plug module is sealed from an environment.

Figure 4:
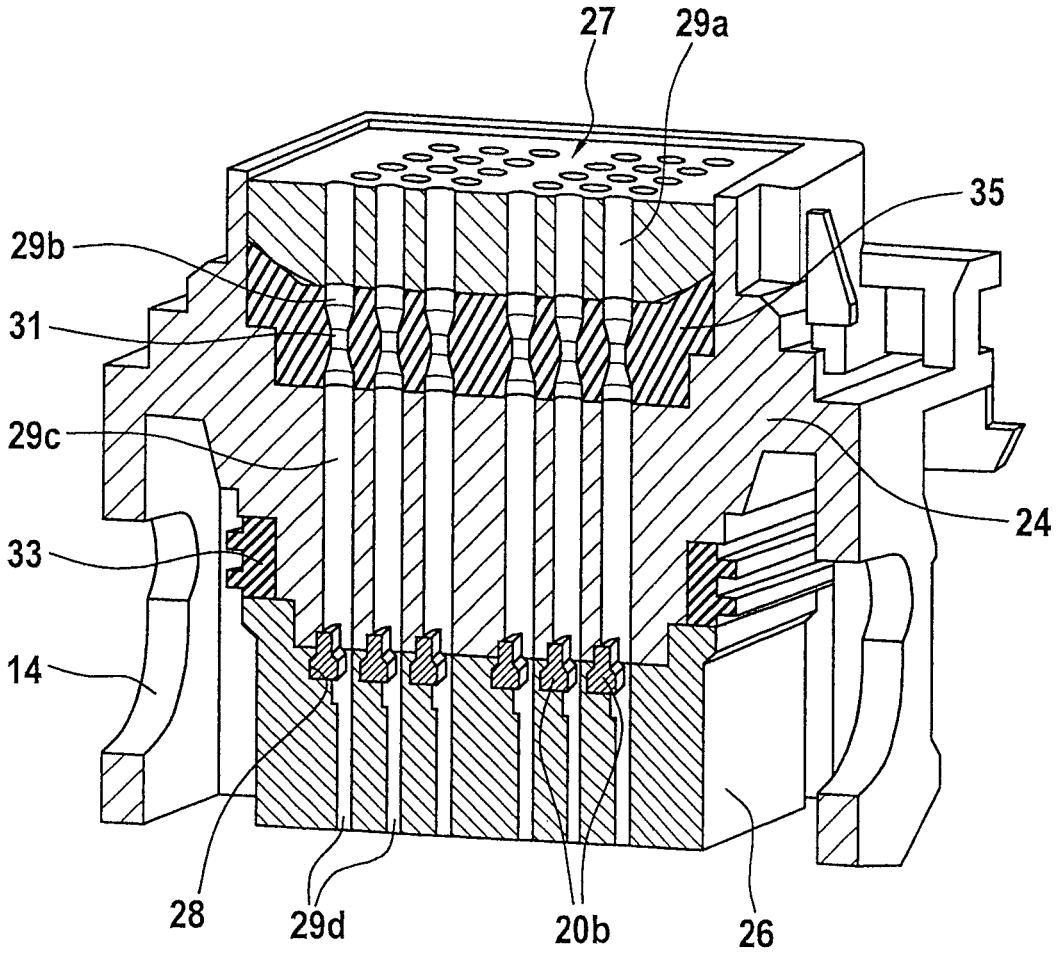
FIG. 4 shows a cross-section along a center plane through the portion of the plug from FIG. 3.

FIG. 4 depicts a cross-section along a center plane running parallel to the axial direction through the components of plug 10 shown in FIG. 3; pressure plate 27 and mat seal 31 are inserted in receiving region 25 of contact carrier upper part 24, and contact carrier lower part 26 is inserted into plug base 14, so that channels 29*a*, 29*b*, 29*c*, 29*d* terminate in each other and form continuous channels for the feed-through of the electrical lines. Channels 29*b* of mat seal 31 furthermore include a tapered region 35 in each case, which is designed to enclose the electrical lines within mat seal 31 in a sealing manner.

Moreover, abutting a boundary surface between contact carrier upper part 24 and contact carrier lower part 26, locking element 18*b* is inserted into plug 10, prongs 20*b* of locking element 18*b* being inserted into recesses 28 that abut each channel 29*c*, 29*d* and are mutually aligned. Prongs 20*b* of locking element 18*b* therefore extend partially in contact carrier upper part 24 and partially in contact carrier lower part 26 with regard to their cross-section. Prongs 20*b* of locking element 18*b* engage with channels 29*c*, 29*d*, transversely to a longitudinal extension direction of channels 29*c*, 29*d*, i.e., at a right angle to the axial direction, so that a subsection of a cross-section of channels 29*c*, 29*d* is taken up by prongs 20*b* in each case. The electrical lines in channels 29*c*, 29*d* are pressed against a wall of channels 29*c*, 29*d*, so that they are fixed in place by means of stiction.

Figure 5:
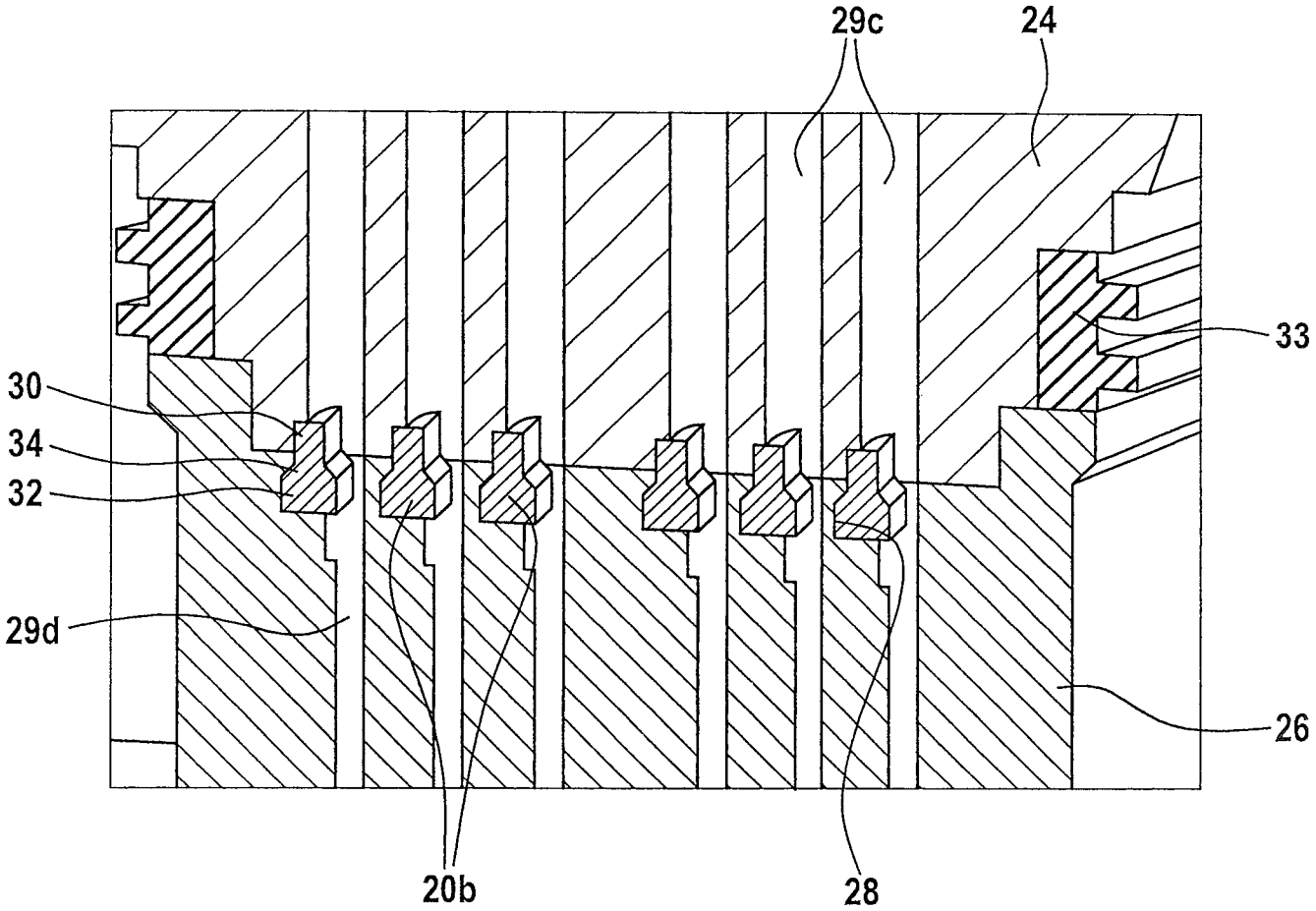
FIG. 5 shows a detail view of a portion of the cross-section through the plug from FIG. 4.

FIG. 5 shows a detail view of the boundary surface between contact carrier upper part 24 and contact carrier lower part 26, in which prongs 20*b*, inserted into the aligned recesses 28, of locking element 18*b* are clearly visible.

Prongs 20*b* have a cross-section including a rectangular upper region 30, which extends in contact carrier upper part 24, a rectangular lower region 32, which extends in contact carrier lower part 26, and a trapezoidal center region 34, which extends along the boundary surface between contact carrier upper part 24 and contact carrier lower part 26 and connects upper region 30 to lower region 32. Rectangular upper region 30 is smaller in its edge length than rectangular lower region 32.

Corresponding to the cross-section of prongs 20*b*, recesses 28 are likewise designed in such a way that prongs 20*b* engage with recesses 28 in a form-fitting manner.

The cross-section of prongs 20*b* of locking element 18*b* as well as the cross-section of the recesses need not necessarily be designed as described in the previous text. For example, with regard to their overall cross-section, prongs 20*b* may also be designed completely in trapezoidal, triangular, rectangular or any other form, recesses 28 being designed according to the cross-section of prongs 20*b*, so that prongs 20*b* are able to engage with recesses 28 in a form-fitting manner and thereby fixate the electrical lines inside plug 10.

What is claimed is:

1. A plug for establishing an electrical connection with a plug module, comprising:

a plug body which has (i) a contact carrier upper part including multiple first channels to accommodate electrical lines, and (ii) a plug base configured to accommodate a collar of the plug module;

a contact carrier lower part which has multiple second channels to accommodate the electrical lines, the first channels of the contact carrier upper part terminating in the second channels of the contact carrier lower part and forming continuous channels to accommodate the electrical lines, wherein the contact carrier lower part is configured to be enclosed by the collar of the plug module and to accommodate multiple electrical contacts of the plug module in order to establish electrical connections between the electrical lines in the plug and the electrical contacts of the plug module; and at least one locking element configured to be inserted into the plug from the outside and configured to fixate the electrical lines in the continuous channels, wherein the at least one locking element extends partially in the contact carrier upper part and partially in the contact carrier lower part.

2. The plug as recited in claim 1, wherein, to fixate the electrical lines, the locking element has a comb configuration with multiple prongs configured to be inserted into at least a sub-region of a cross-section of the continuous channels for accommodating the electrical lines, whereby the electrical lines are pressed against the contact carrier upper part and the contact carrier lower part and are fixated in the process.

3. The plug as recited in claim 2, wherein the locking element fixates the electrical lines by stiction.

4. The plug as recited in claim 2, wherein both the contact carrier upper part and the contact carrier lower part have mutually aligned recesses at a boundary surface between the contact carrier upper part and the contact carrier lower part, abutting each channel, and wherein the locking element is inserted into the recesses.

5. The plug as recited in claim 4, wherein the prongs of the locking element are configured to engage with the recesses in a form-locking manner.

6. The plug as recited in claim 2, wherein the plug and the locking element are configured in such a way that the locking element is inserted into the plug transversely to a longitudinal extension direction of the continuous channels.

7. The plug as recited in claim 2, wherein at least two locking elements are provided, the at least two locking elements being configured to be inserted into the plug at two opposite sides of the plug.

8. The plug as recited in claim 7, wherein the two locking elements differ in the number of prongs configured to be inserted into the plug.

9. The plug as recited in claim 5, wherein the locking element is configured in one piece.

10. The plug as recited in claim 9, wherein the locking element is made of plastic.

11. A plug system, comprising:

a plug module; and a plug for establishing an electrical connection with the plug module, the plug including:

a plug body which has (i) a contact carrier upper part including multiple first channels to accommodate electrical lines, and (ii) a plug base configured to accommodate a collar of the plug module;

a contact carrier lower part which has multiple second channels to accommodate the electrical lines, the first channels of the contact carrier upper part terminating in the second channels of the contact carrier lower part and forming continuous channels to accommodate the electrical lines, wherein the contact carrier lower part is configured to be enclosed by the collar of the plug module and to accommodate multiple electrical contacts of the plug module in order to establish electrical connections between the electrical lines in the plug and the electrical contacts of the plug module; and at least one locking element configured to be inserted into the plug from the outside and configured to fixate the electrical lines in the continuous channels, wherein the at least one locking element extends partially in the contact carrier upper part and partially in the contact carrier lower part.

* * * * *